US005220999A

United States Patent [19]

Goulette

[11] Patent Number: 5,220,999

[45] Date of Patent: Jun. 22, 1993

[54] NESTABLE HINGED CONTAINER FOR THE DISPLAY AND STORAGE OF CONSUMER ARTICLES

[75] Inventor: Stephen L. Goulette, Newark, N.Y.

[73] Assignee: Mobil Oil Corporation, Fairfax, Va.

[21] Appl. No.: 816,790

[22] Filed: Jan. 3, 1992

Related U.S. Application Data

[63] Continuation of Ser. No. 616,473, Nov. 21, 1990, abandoned.

[51] Int. Cl.[5] ..... B65D 25/00

[52] U.S. Cl. ..... 206/45.32; 206/45.34; 206/470; 206/508; 206/806; 220/4.22; 220/4.23; 229/2.5 R

[58] Field of Search ..... 206/45.34, 303, 470, 206/503, 508, 551, 806, 461, 45.32; 229/2.5 R; 220/4.22, 4.23, 4.24, 4.25, 339

[56] References Cited

U.S. PATENT DOCUMENTS

| | | | |
|---|---|---|---|
| 2,246,695 | 10/1937 | Phillips | 206/44 |
| 2,798,784 | 7/1957 | Marshall | 220/4.24 |
| 2,845,104 | 7/1958 | Frankel | 220/4.23 |
| 2,914,104 | 11/1959 | Jocelyn | 150/5 |
| 3,001,665 | 9/1961 | Tomarin | 206/508 |
| 3,043,354 | 7/1962 | Fitzgerald | 220/4.23 |
| 3,053,424 | 9/1962 | Reinhard | 206/303 |
| 3,138,432 | 6/1964 | Kleinhans | 206/806 |
| 3,176,879 | 4/1965 | Mojonnier | 220/4.24 |
| 3,253,762 | 5/1966 | Gaunt | 229/2.5 |
| 3,292,810 | 12/1966 | Schechter | 220/4.24 |
| 3,303,964 | 2/1967 | Luker | 206/45.34 |
| 3,429,629 | 2/1968 | Cilia | 206/806 |
| 3,511,433 | 5/1970 | Andrews et al. | 220/4.23 |
| 3,530,917 | 2/1969 | Donovan | 229/2.5 |
| 3,565,321 | 2/1971 | Weiss | 229/2.5 |
| 3,590,988 | 7/1971 | Holler | 206/45.34 |
| 3,645,384 | 2/1972 | Wind | 220/339 |
| 3,770,115 | 11/1973 | Cannell | 206/45.32 |
| 3,794,090 | 2/1974 | Commisso | 150/0.05 |
| 3,871,519 | 3/1975 | Groomers | 220/4.24 |
| 3,876,130 | 4/1975 | Haase | 220/4.23 |
| 3,937,389 | 2/1976 | Wind | 220/339 |
| 4,013,214 | 3/1977 | Hansen et al. | 220/4.22 |
| 4,061,241 | 12/1977 | Retelny | 229/2.5 |
| 4,096,986 | 6/1978 | Florian | 220/4.23 |
| 4,143,805 | 3/1979 | Sutton | 220/4.23 |

(List continued on next page.)

FOREIGN PATENT DOCUMENTS

| | | | |
|---|---|---|---|
| 383677 | 8/1990 | European Pat. Off. | 220/339 |
| 1486242 | 5/1969 | Fed. Rep. of Germany | 206/45.34 |
| 2255800 | 7/1975 | France | 206/508 |
| 2025757 | 1/1980 | United Kingdom | 220/339 |
| 2061880 | 5/1981 | United Kingdom | 220/339 |

OTHER PUBLICATIONS

Alloyd Co., "Clamshell" Advertisement, Aug. 1986 from vol. 31, No. 9 "Packaging", p. 53.

*Primary Examiner*—David T. Fidei
*Attorney, Agent, or Firm*—Alexander J. McKillop; Charles J. Speciale; Michael J. Mlotkowski

[57] ABSTRACT

A nestable hinged container for packaging consumer articles. The container includes a receptacle having a base formed with relation to the consumer article, the base terminating in an uppermost edge having an outer periphery, the receptacle further having an upstanding peripheral side wall integral to the outer periphery of the uppermost edge of the base, the peripheral side wall terminating at an upper end thereof in an outwardly projecting peripheral rim flange; and a lid hingedly connected to the receptacle, the lid having an an outwardly projecting peripheral rim flange and an inwardly projecting concave portion located on an upper surface of the lid, the concave portion formed in relation to the base so as to enable nested stacking of a plurality of the containers.

4 Claims, 4 Drawing Sheets

U.S. PATENT DOCUMENTS

| | | | |
|---|---|---|---|
| 4,183,446 | 1/1980 | Davis | 220/4.23 |
| 4,202,464 | 5/1980 | Mohs et al. | 220/339 |
| 4,206,845 | 6/1980 | Christian | 229/2.5 |
| 4,244,470 | 1/1981 | Barnham | 229/2.5 |
| 4,273,249 | 6/1981 | Florian | 220/4.25 |
| 4,570,818 | 2/1986 | Borst et al. | 220/339 |
| 4,732,273 | 3/1988 | DeMarco | 206/470 |
| 4,733,779 | 3/1988 | Hubmann et al. | 206/45.34 |
| 4,742,914 | 5/1988 | Klein | 206/806 |
| 4,747,510 | 5/1988 | Mack | 206/508 |
| 4,753,351 | 6/1988 | Guillin | 206/520 |
| 4,753,366 | 6/1988 | Ritter | 220/339 |
| 4,754,874 | 7/1988 | Haney | 206/45.34 |
| 4,754,896 | 7/1988 | Roltgen et al. | 220/339 |
| 4,807,747 | 2/1989 | Hadtke | 206/470 |
| 4,848,541 | 7/1989 | Paliotta et al. | 206/461 |
| 4,848,543 | 7/1989 | Doboze | 206/551 |
| 4,874,083 | 10/1989 | Antoni et al. | 229/2.5 |
| 4,896,770 | 1/1990 | Caberano et al. | 206/806 |
| 4,915,251 | 4/1990 | Payne | 229/2.5 |
| 4,947,993 | 8/1990 | Bruml et al. | 206/551 |
| 4,986,438 | 1/1991 | Borst | 220/339 |

NESTABLE HINGED CONTAINER FOR THE DISPLAY AND STORAGE OF CONSUMER ARTICLES

This is a continuation of copending application U.S. patent application Ser. No. 07/616,473 filed on Nov. 21, 1990 abandoned.

FIELD OF THE INVENTION

The present invention relates to disposable containers having covers and, more particularly, to a nestable container having a hinged for the display and storage of the product contained therein.

BACKGROUND OF THE INVENTION

In the field of plastic packaging for the distribution and display of consumer articles such as disposable tableware, including plates, bowls and the like, a wide variety of packaging means have been employed. As may be recognized, transparent shrink wrap is a material widely used for the packaging and displaying of disposable tableware, such as picnic ware and birthday plates. While such material provides the desired ready display of the articles contained within the package, once the package is opened, the consumer is faced with repackaging the remaining articles since the shrink wrap material generally is not suitable for reuse.

It is well known that the appearance of a particular product often provides the motivation necessary for the consumer to purchase it. As is often the case in today's competitive marketplace, products fairly equivalent in quality find themselves positioned side-by-side on the retailer's shelf. If the appearance of the container is pleasing or, if there is some utility or additional feature which the container provides, it can and does often induce the consumer to purchase the item so packaged.

As a replacement for shrink wrap, a reusable plastic container could be employed. At present, a large number of containers are manufactured and adapted to the requirements of the producers and distributors of foods and consumer goods. For example, U. S. Pat. No. 2,246,695 discloses a container for cakes, pies and similar articles of food. The container provides a dish with reinforcing ribs for containing the article of food and a flexible, removable transparent cover.

U.S. Pat. No. 2,914,104 discloses a flexible container molded from a plastic material, such as polyethylene, which comprises two container members adapted to be releasably joined together around an outer annular edge thereof in a substantially sealing relation.

In another example, U.S. Pat. No. 3,590,988 provides a two-piece display and shipping container having a transparent housing that forms a locking engagement with a base member having an inner product engaging ring for holding the product securely within the container.

U.S. Pat. No. 3,770,115 discloses a packaging container for shipping and displaying pies consisting of a shock-absorbing base shell of concave form which receives and supports a pie pan in such a manner that shocks are not readily transmitted. A transparent convex cover is provided which snaps onto the base shell and grips the flange or rim of the pan. The base shell and the cover are complementary in form so that the container assemblies can be stacked without the likelihood of being displaced laterally, the shell of one assembly resting on and interfitting with the cover of the next assembly below.

U.S. Pat. No. 3,794,090 is related to a covered container wherein the top of the cover has a recessed region which is contoured to mate with the bottom of the dishes with which the cover is employed so that a plurality of covered dishes may be placed one upon another to facilitate transportation and distribution of the filled containers to the points of use.

U.S. Pat. No. 4,753,351 discloses a covered container for packaging hot or cold foods or other goods which is produced by thermoforming sheets of plastic. The container is characterized by its prismatic shape and polygonal base, which on stacking, holds the container firmly and rigidly whether empty or filled. Unlike the aforementioned disclosures, the container disclosed in U.S. Pat. No. 4,753,351 employs an attached and hinged cover, the hinge formed by three wave-shaped folds which on deformation allow the cover to swing on opening and closing the container.

While the aforementioned containers are manufactured and adapted to meet the requirements of the producers and distributors instrumental in their design, they generally do not meet the needs presented in the field of plastic packaging for the distribution and display of consumer articles such as disposable tableware, including plates, bowls and the like. As can be appreciated, to be competitive with other similar goods, the goods must be packaged in such a way so as to permit display in a substantially conventional manner. For example, if disposable tableware is conventionally displayed on a pegboard, or placed upright so that the design of the product is readily observable, than an improved packaging container for use with that product should also be capable of such display so that the consumer will be provided with the opportunity of side-by-side comparison on the retailer's shelf. If the appearance of the container is pleasing or offers some utility or additional feature not otherwise provided, the consumer may be induced to purchase the item so packaged.

Therefore, a need exists for a container which is reusable, capable of display in a conventional manner, provides an advantage over conventional shrink wrapped packages from the standpoint of shipping and is pleasing in appearance.

SUMMARY OF THE INVENTION

In accordance with the present invention, there is provided a nestable hinged container for packaging at least one or several consumer articles. The container includes a receptacle having a base formed with relation to the consumer article, the base terminating in an uppermost edge having an outer periphery, the receptacle further having an upstanding peripheral side wall integral to the outer periphery of the uppermost edge of the base, the peripheral side wall terminating at an upper end thereof in an outwardly projecting peripheral rim flange; and a lid hingedly connected to the receptacle, the lid having an an outwardly projecting peripheral rim flange and an inwardly projecting concave portion located on an upper surface of the lid, the concave portion formed in relation to the base so as to enable nested stacking of a plurality of the containers.

Therefore, it is an object of the present invention to provide a disposable container in which the contents are pleasingly displayed at the point of sale.

It is another object of the present invention to provide such a container which is easy to manufacture and fill and is reasonably rigid and durable.

It is a further object of the present invention to provide a container in which at least a majority of the wall portions thereof are constructed of a transparent material whereby the contents of the container may be viewed at the point of sale.

It is yet another object of the present invention to provide a container which is reusable and sufficiently durable to remain functional at least until the supply of product contained therein is exhausted.

Other objects and the several advantages of the present invention will become apparent to those skilled in the art upon a reading of the specification and the claims appended thereto.

BRIEF DESCRIPTION OF THE DRAWINGS

The actual construction, configuration and advantages of the present invention will be better understood by referring to the following drawings in which like numerals identify like elements and in which.

DETAILED DESCRIPTION OF THE INVENTION

Figure 1:
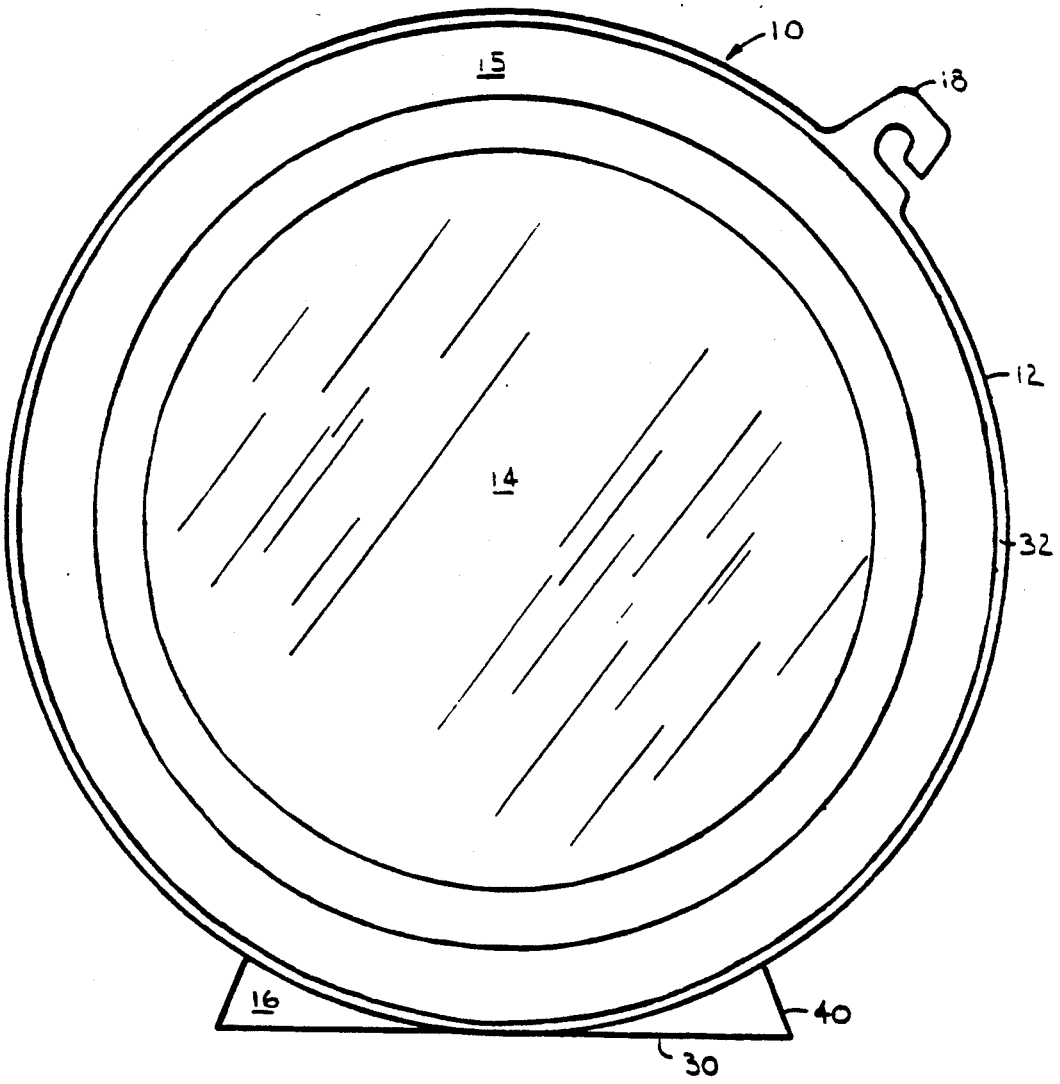
FIG. 1 is a top view of a preferred embodiment of a nestable hinged container for packaging consumer articles, in accordance with the present invention.

The present invention is best understood by reference to the appended figures, which are given by way of example and not of limitation. Referring now to FIG. 1, a top view of a preferred embodiment of a nestable hinged container 10 is shown. Lid 12 of container 10 is shown in the closed position. Lid 12 has an outwardly projecting peripheral rim flange 32 and an inwardly projecting concave portion 14 located on an upper surface 15 of lid 12. It is presently preferred that nestable hinged container 10 be made of a thin gauge synthetic thermoplastic such as biaxially oriented transparent polystyrene (OPS). When OPS is employed, a gauge thickness on the order of about 8 mils to about 14 mils is known to provide suitable performance. Other clear or opaque plastics having the requisite strength and ease of processing may also be employed. Nestable hinged container 10 may be produced, as is preferred, utilizing a conventional thermoforming operation.

Figure 2:
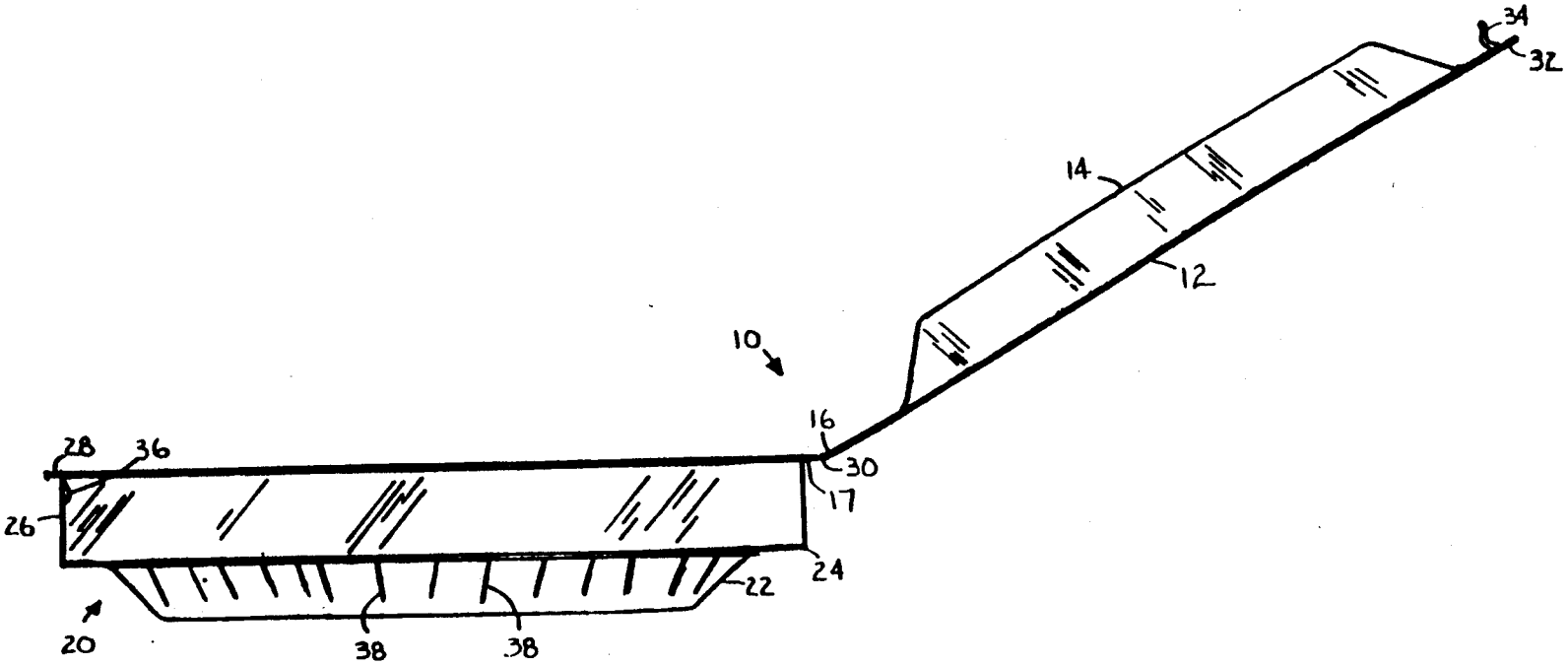
FIG. 2 is a side view of the FIG. 1 embodiment of a nestable hinged container for packaging consumer articles, shown in an open condition.

Referring now to FIG. 2, a side view of the FIG. 1 embodiment of the nestable hinged container 10 is depicted with lid 12 in an open condition. As may be seen, container 10 is comprised of a receptacle 20 having a base 22, base 22 terminating at its top in an uppermost edge 24. Receptacle 20 also has an upstanding peripheral side wall 26 which is integral to the outer periphery of the uppermost edge 24 of base 22. Peripheral side wall 26 terminates at its upper end in an outwardly projecting peripheral rim flange 28. As is preferred, base 22 is formed with relation to the shape of the consumer article which it will contain and display. The base 22 depicted in FIGS. 1 through 4 is formed with relation to the shape of disposable plates, such as picnic or birthday plates, as those skilled in the art will readily recognize. As can be envisioned, a plurality of disposable plates can be held by receptacle 20 of container 10 and, when lid 12 is closed, inwardly projecting concave portion 14 of lid 12 will fit within the dished center portion of the plates. It is to be understood that the containers of the present invention may assume a wide variety of shapes as necessitated by the particular application to be practiced. To provide increased container rigidity and reduced resin utilization, base 22 can be provided with a plurality of ribs 38, radially disposed about base 22.

Still referring to FIG. 2, lid 12 is shown to be hingedly connected by hinge 30 to receptacle 20. Hinge 30 may be a simple folding-type hinge, as shown, or any other type of hinge selected from the many well known hinge configurations familiar to those skilled in the art, such as a tri-fold hinge. Hinge 30 of the embodiment depicted in FIGS. 1-4, is located at a line of join of the outermost edges (when container 10 is in the closed position) of tangential extension flanges 16 and 17. Tangential extension flange 16 may be seen to be an extension of outwardly projecting peripheral rim flange 32 of lid 12 (see FIG. 1), with tangential extension flange 17 being an extension of outwardly projecting peripheral rim flange 28 of receptacle 20.

Figure 3:
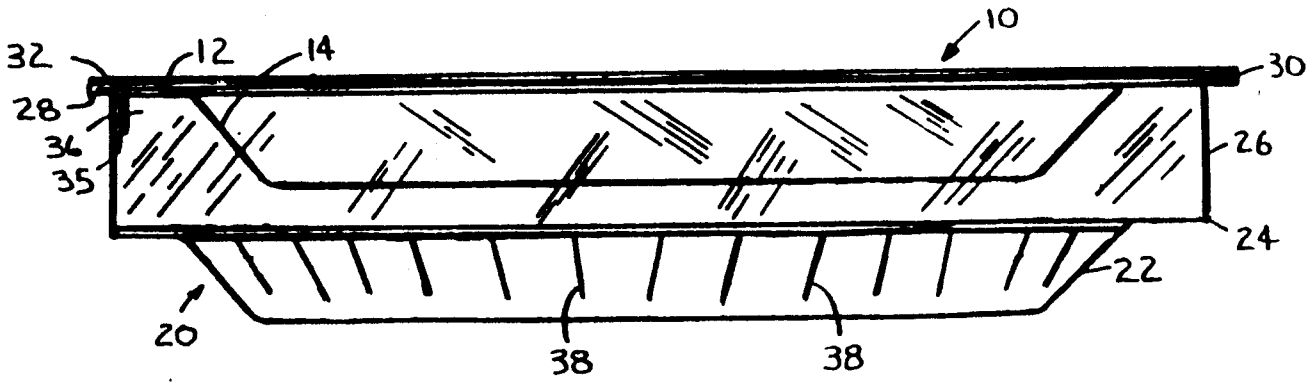
FIG. 3 is a side view of the FIG. 1 embodiment of a nestable hinged container for packaging consumer articles, shown in a closed condition.

With reference now to FIG. 3, a side view of the nestable hinged container 10 is shown in a closed condition. To enhance the ability of container 10 to remain in the closed condition, container 10 can be provided with optional locking means 35. Optional locking means 35 may be selected from any of a number of the conventional locking means well known to those skilled in the art of thermoforming of disposable containers. Such locking means include one or more tab and slot combinations, one or more mating recess and projection combinations, an interfering fit of mating members and the like. Shown in the embodiment of FIGS. 1 through 4 is tongue 34, tongue 34 having a recessed surface and a mating projection 36. Mating projection 36 is located on an interior surface of upstanding peripheral side wall 26 at an end opposite from hinge 30. As can be appreciated by those skilled in the art, the precise location of locking means 35 is not critical to the functioning of the present invention.

Still referring to FIG. 3, inwardly projecting concave portion 14 of lid 12 may be seen to have been formed in relation to base 22 of receptacle 20, so as to enable the nested stacking of a plurality of the containers 10. As is desired in order to achieve a space efficient interfitting structure which is operable to retain one closed container 10 in stable relation when stacked upon another container 10, inwardly projecting concave portion 14 is located centrally within lid 12. By the proper sizing of base 22 and inwardly projecting concave portion 14, stacks of like containers 10 can be formed which require less bulk shipping and storage volume than a corresponding stack of similar products which have been packaged in shrink wrap, a feature highly desired by those skilled in the art.

Figure 4:
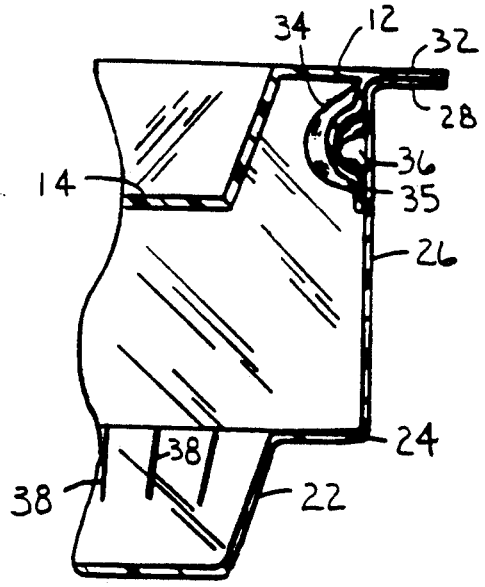
FIG. 4 is an enlarged, fragmentary view, in cross-section, of a closed, nestable hinged container, showing in detail one type of container closure means.

Referring now to FIG. 4, an enlarged, fragmentary view in cross-section of nestable hinged container 10 is presented. Container 10 is shown in the closed position, with the recess of tongue 34 of lid 1 in interlocking relation with mating projection 36, located on upstanding peripheral side wall 26 of receptacle 20. As can be appreciated, the flexible nature of the preferred thin-gauge OPS material, in cooperation with a locking means comprised of a mating recess and projection combination, provides a container which can be repeatedly opened and closed many times without failure, an attribute highly desired in the marketing of consumer articles such as disposable tableware.

Referring again to FIG. 1, it may be seen that container 10 can be provided with means for displaying the container in a retail establishment. As shown, container 10 is provided with display hook 18 which may be used for hanging container 10 from a pegboard hanger. As is preferred, display hook 18 is integral to peripheral rim flange 32 of lid 12. Equally effective, display hook 18 may be formed integral to peripheral rim flange 28 of receptacle 20. When heavier articles are to be packaged or very thin gauge material is to be utilized, a display hook 18 which is formed by the combination of adjacent hook members can be employed wherein a first hook member is integral to peripheral rim flange 32 of lid 12 and a second hook member is integral to peripheral rim flange 28 of receptacle 20. Additionally, a formed stand member 40 is also provided for use as an alternate means for displaying container 10. As may be seen, stand member 40 is formed by the combination of tangential extension flanges 16 and 17 which, as indicated above, are an extension of outwardly projecting peripheral rim flange 32 of lid 12 and outwardly projecting peripheral rim flange 28 of receptacle 20, respectively.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A transparent nestable hinged container for packaging at least one consumer article, comprising:

(a) a substantially circular receptacle having a base formed with relation to the consumer article, said base terminating in an uppermost edge having an outer periphery, said receptacle further having an upstanding peripheral side wall integral to said outer periphery of said uppermost edge of said base, said peripheral side wall terminating at an upper end thereof in an outwardly projecting peripheral rim flange, said base of said receptacle having a plurality of radially disposed ribs for increased rigidity;

(b) a substantially circular lid hingedly connected to said receptacle, said lid having an outwardly projecting peripheral rim flange and an inwardly projecting concave portion located on an upper surface of said lid, said concave portion formed in relation to said base so as to enable nested stacking of a plurality of the containers, said hinge connecting said lid to said receptacle comprises material extensions of said outwardly projecting peripheral rim flange of said receptacle and said outwardly projecting peripheral rim flange of said lid, said material extensions joined together along a line at an outermost edge thereof;

(c) a releasable locking means matingly connecting said lid to said receptacle in a closed state of said container;

(d) a display hook integral to said peripheral rim flange of said lid; and (e) a display stand member formed by a combination of tangential extension flanges said tangential extension flanges being an extension of said outwardly projecting peripheral rim flange of said lid and said outwardly projecting peripheral rim flange of said receptacle;

wherein said releasable locking means comprises a tongue connected to said lid, said tongue having a recess, and a mating projection located on an interior surface of said upstanding peripheral side wall of said receptacle.

2. The container of claim 1, wherein said base and said receptacle are manufactured by thermoforming a sheet of thermoplastic material.

3. The container of claim 2, wherein said sheet of thermoplastic material is biaxially oriented polystyrene.

4. The container of claim 10, wherein said sheet of biaxially oriented polystyrene has a gauge thickness of from about 8 mils to about 14 mils.

* * * * *